US005859656A

United States Patent [19]

Aragon et al.

[11] Patent Number: 5,859,656

[45] Date of Patent: Jan. 12, 1999

[54] APPARATUS FOR PROVIDING BACK TENSION ON A PRINT MEDIA WEB

[75] Inventors: Cathy L. Aragon, Snohomish; Todd W. Leiby, Seattle; Duane M. Fox, Snohomish, all of Wash.

[73] Assignee: Intermec IP Corp., Beverly Hills, Calif.

[21] Appl. No.: 727,116

[22] Filed: Oct. 8, 1996

[51] Int. Cl.[6] ..... B65H 59/38

[52] U.S. Cl. ..... 347/218; 347/219; 400/618; 242/419.9

[58] Field of Search ..... 347/215, 218, 347/219; 400/618, 234; 242/410, 419.9, 419.4, 423, 423.1, 422.4, 422.5; 101/DIG. 42, 228

[56] References Cited

U.S. PATENT DOCUMENTS

| | | | |
|---|---|---|---|
| 3,107,064 | 10/1963 | Price et al. | 345/136 |
| 3,866,851 | 2/1975 | Brooks | 242/421.9 |
| 3,899,143 | 8/1975 | Slezak | 242/156.2 |
| 3,949,949 | 4/1976 | Thompson | 242/421 |
| 3,985,603 | 10/1976 | Berner | 156/235 |
| 3,985,605 | 10/1976 | Treiber et al. | 156/384 |
| 3,989,929 | 11/1976 | Treiber | 235/432 |
| 4,350,454 | 9/1982 | Schoenlein | 400/234 |
| 4,363,692 | 12/1982 | Imamura et al. | 156/351 |
| 4,521,125 | 6/1985 | Turbon | 400/208 |
| 4,721,267 | 1/1988 | Nieto et al. | 242/598.4 |
| 5,051,011 | 9/1991 | Satoh et al. | 400/219 |
| 5,338,443 | 8/1994 | McEwen | 210/91 |

FOREIGN PATENT DOCUMENTS 63-194971 8/1988 Japan .

*Primary Examiner*—N. Le
*Assistant Examiner*—Anh T. N. Vo
*Attorney, Agent, or Firm*—Graham & James LLP

[57] ABSTRACT

An apparatus for providing back tension onto a print media web comprises a plate having a post extended perpendicularly therefrom. The post is adapted to support a roll of print media thereon such that a web of the print media roll is paid out by rotation of the roll about the post. A constant-force spring is attached to a portion of the media plate at and has a handle coupled to an opposite end of the spring. A pressing element is coupled to the handle such that the spring is biased to urge the pressing element against the media supply roll to maintain the roll firmly in contact with the post during rotation of the roll. The force provided by the pressing element onto the media supply roll imparts sufficient back tension on the print media web to maintain a constant pay out rate. The present back tension apparatus provides a relatively simple mechanism that is readily adaptable for many conventional printers, such as a thermal transfer printer.

10 Claims, 6 Drawing Sheets

APPARATUS FOR PROVIDING BACK TENSION ON A PRINT MEDIA WEB

BACKGROUND OF THE INVENTION

1. Field of the Invention

The present invention relates to thermal printing, and more particularly, to an apparatus for providing back tension on a print media web as it is transported through a thermal printer.

2. Description of Related Art

In the field of bar code symbology, vertical bars of varying thicknesses and spacing are used to convey information, such as an identification of the object to which the bar code is affixed. Bar codes are often printed onto a print media comprising individual paper substrate labels having an adhesive backing layer that enables the labels to be affixed to objects to be identified. To read the bar code, the bar and space elements of the bar code may be scanned by a moving light source, such as an articulating laser beam. Alternatively, the bar and space elements may be imaged in one or two-dimensions by a photosensitive imaging element, such as a charge coupled device. Since the bar and space elements have differing light reflective characteristics, the information contained in the bar code can be read by interpreting the reflected light or image pattern from the bar code. In order to accurately read the bar code, it is thus essential that the bar code be printed in a high quality manner, without any streaking, blurring or misregistration of the bar code. At the same time, it is essential that the adhesive backing layer of the labels not be damaged by heat generated during the printing process.

In view of these demanding printing requirements, bar codes are often printed using direct thermal or thermal transfer printing techniques. In direct thermal printing, the print media is impregnated with a thermally sensitive chemical that is reactive upon exposure to heat for a period of time. Thermal transfer printing requires an ink ribbon that is selectively heated to transfer ink to the print media. These printing techniques are referred to collectively herein as thermal printing.

To print the bar code, the print media is drawn between a platen and a thermal print head of the printer. The thermal print head has linearly disposed printing elements that extend across a width dimension of the print media. The printing elements are individually activated in accordance with instructions from a printer controller. As each printing element is activated, the thermally active chemical of the ribbon activates at the location of the particular printing element to transfer ink to the printed area of the print media. The print media is continuously drawn through the region between the platen and the thermal print head, and in so doing, the bar code is printed onto the print media as it passes through the region. Other images, such as text, characters or graphics, can be printed in the same manner. The thermal printer includes a mechanism for transporting the print media from a supply hub to the print region. Such printers typically include a media post or hub onto which is mounted a supply roll of the print media material. The media post is substantially smaller in cross-section than the core of the media supply roll so that the post can accommodate media supply rolls of various sizes. As the media supply roll is rotated under take-up tension applied by the transporting mechanism, a web of the print media is paid out and transported past the thermal print head.

The movement of the print media must be precisely coordinated with the operation of the thermal print head in order to ensure accurate registration of the printed information to the print media. Top-of-form registration refers to the alignment of the printed information to the beginning or leading edge of a print media label. A top-of-form registration error occurs when the printing begins either too soon or too late. Sensing circuits are often utilized to detect the gap between adjacent labels in order to accurately coordinate the printing to the leading edge. Lateral registration refers to the alignment of the printed information to the left and right side edges of the label, and a lateral registration error occurs when the print media supply roll is not properly stabilized with respect to the media post. Print media labels often include pre-printed material with designated spaces for printing bar codes and other information. Thus, registration errors can result in overlapping between the pre-printed material and the newly printed information, causing the newly printed information to become obscured. In some cases, a lateral registration error could cause the bar code symbol or text to run off the edge of the label, rendering the bar code unreadable.

Both types of print registration error conditions can be adversely effected by insufficient back tension applied to the print media web. Initially, the weight of the media supply roll is sufficient to maintain a positive connection between the media supply roll and the media post to prevent the web from paying out at an uneven rate or wandering laterally on the media post. As the media supply roll is paid out, however, its size and weight decreases until it no longer provides sufficient back tension to the web. Thereafter, the supply roll starts lifting off of the media post and shifting position laterally along the media post. In turn, this causes the pay out rate of the print media to fluctuate which ultimately results in undesirable degradation of both lateral and top-of-form registration.

Accordingly, it would be desirable to provide a mechanism for a thermal transfer printer that would provide sufficient back tension on the rotating media supply roll in order to maintain a consistent transport rate of the media web as it is paid out. At the same time, the mechanism should not overly complicate the printer or substantially increase its production cost.

SUMMARY OF THE INVENTION

In accordance with the teachings of the present invention, an apparatus for applying back tension onto a print media web is provided. The back tension applying apparatus provides a relatively simple mechanism that is readily adaptable for many conventional printers, such as a thermal transfer or direct thermal printer.

In an embodiment of the present invention, a printer includes a media plate having a post extended perpendicularly therefrom that is adapted to support a roll of print media thereon such that a web of the print media roll is paid out by rotation of the roll about the post. A constant-force spring is attached to a portion of the media plate and has a handle coupled to an opposite end of the spring. A pressing element is further coupled to the handle such that the bias of the spring urges the pressing element against the media supply roll to maintain the roll firmly in contact with the post during rotation of the roll. The force provided by the pressing element onto the media supply roll imparts sufficient back tension on the print media web to maintain a constant pay out rate.

More particularly, the handle comprises an elongated channel portion and the plate comprises a standoff fixedly attached thereto. The standoff is adapted to fit within the channel portion to provide a guide for movement of the handle. The plate further comprises a slot disposed therein with the handle extending at least partially through the slot. The slot further provides a guide for movement of the handle. A rotatable drum is coupled to the media plate, and the spring further comprises a tape spring wound onto the drum. The pressing element further comprises a wheel which is rotatable in cooperation with rotation of the roll. The wheel is disposed at a canted angle with respect to a direction of pay out of the web from the roll. The handle can also be locked in a position in which the pressing element does not contact the media roll, permitting periodic replacement of the roll or use of the printer without back tension being applied.

A more complete understanding of the apparatus for providing back tension on a print media web will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention satisfies the need for a simple and inexpensive mechanism for providing back tension to a roll of print media as a web of the media is paid out to a print head of a thermal transfer printer. In the detailed description that follows, it should be appreciated that like element numerals are used to describe like elements that are illustrated in one or more of the figures.

Figure 1:
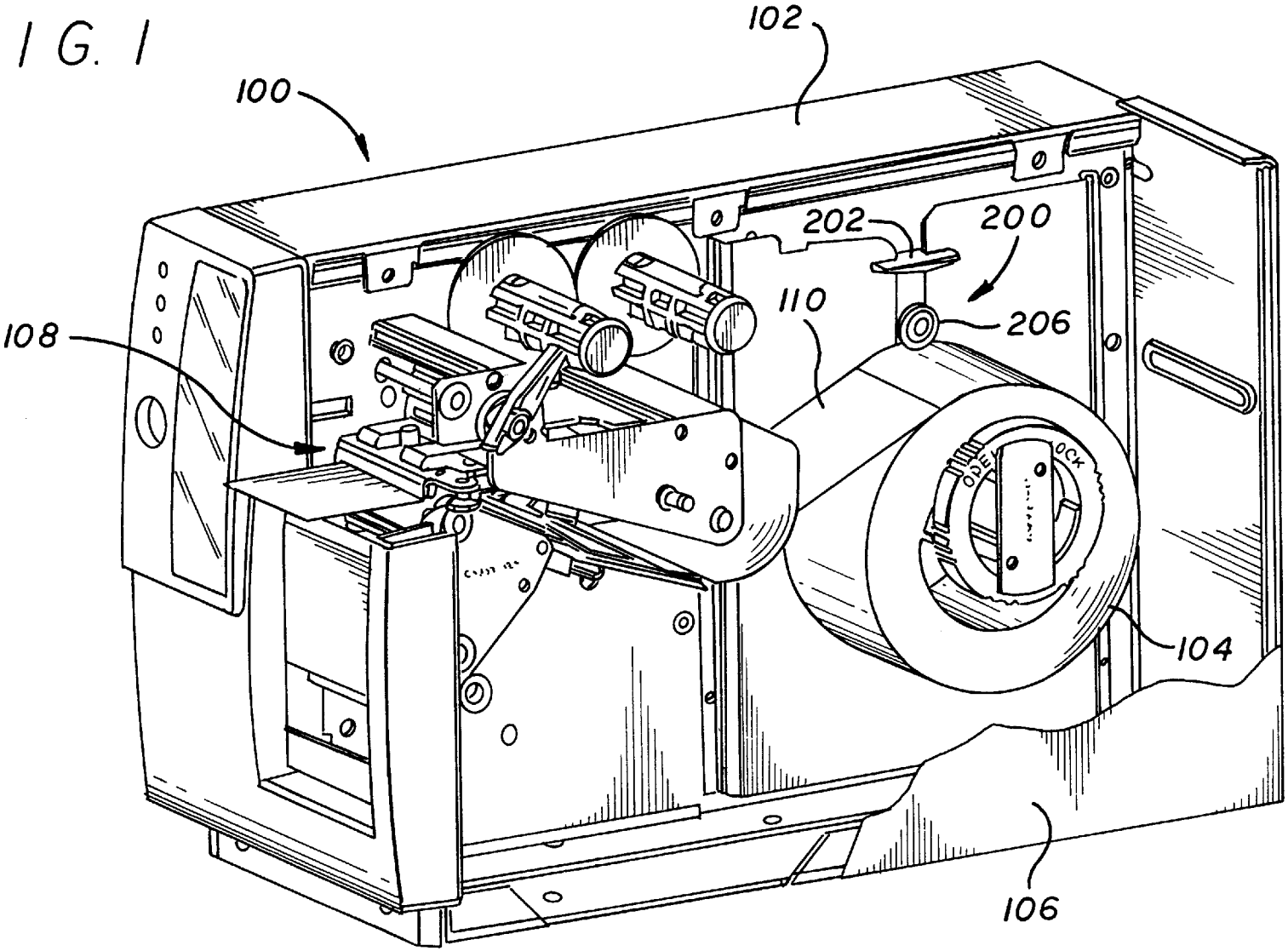
FIG. 1 illustrates a perspective view of an exemplary printer that utilizes the back tension providing mechanism of the present invention.
Figure 2:
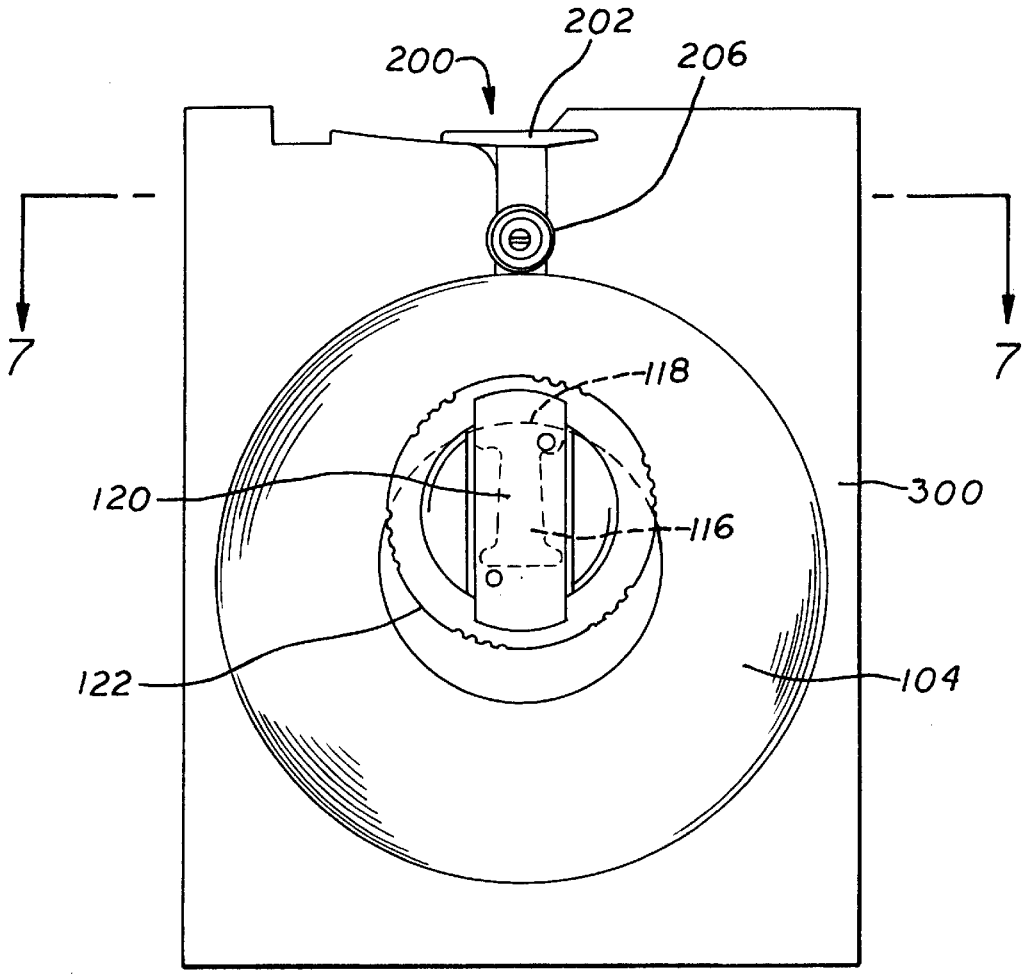
FIG. 2 illustrates a side view of a back tension providing mechanism mounted on a media plate of the printer of FIG. 1.

Referring first to FIGS. 1 and 2, a printer 100 utilizing a back tension apparatus of the present invention is disclosed. The printer 100 comprises a housing 102 which encloses the operative elements of the printer. In a preferred embodiment of the present invention, the printer 100 comprises a thermal printer which includes a transport mechanism that will transport print media to a thermal print head (not shown). As known in the art, the transport mechanism may further include a platen driven by a motor to draw a web of the print media thereto. It should be understood that these conventional elements of a printer otherwise not pertinent to the discussion of the present invention are omitted for simplicity, but would necessarily be included in an actual printer.

The housing 102 includes a removable panel 106 that permits access to an internal portion of the printer 100 in which a media supply roll 104 is operatively disposed. An operator of the printer 100 would load a new media supply roll 104 into the printer through an opening defined by removal of the panel 106, and conversely, would remove an empty core of a media supply roll through the opening once the supply roll is spent. A web 110 of the print media is paid out from the media supply roll 104 to the print head of the printer 100 by operation of the transport mechanism, and printed media thus exits the printer housing 100 via a media exit opening 108 disposed at a front portion of the printer.

A media plate 300 comprises a portion of the internal structure of the printer 100. A media supply post 116 extends perpendicularly through an opening in the media plate 300, as will be described below. The media supply roll 104 has a central core that rests on the upper surface of the media supply post 116. As illustrated in phantom in FIG. 2, the media supply post 116 has a cross-section smaller than the central core of the media supply roll 104, and has a rounded upper surface 118 to promote rotation of the media supply roll 104 about the post as it is driven by the transporting mechanism. The media supply post 116 may be either non-rotatable or may include a bearing mounted roller at the upper surface that promotes rotation of the media supply roll 104. In the alternative, the media supply post 116 may be a rotating element that is controlled by motors, gears or a clutch assembly. A locking mechanism comprising a ring 122 that can be rotated between a locked and unlocked position to minimize lateral movement of the media supply roll 104 may also be provided. An end cap 120 prevents removal of the ring 122 from the media supply post 116.

A tension providing mechanism 200 is mounted on the media plate 300 for providing back tension to the media supply roll 104. As illustrated in FIGS. 1 and 2, the tension providing mechanism 200 comprises a wheel 206 which is pressed against an upper surface of the media supply roll 104. The wheel 206 rotates in unison with the rotating media supply roll 104, and applies a downward force on the media supply roll so that the pay out of a web 110 of media from the media supply roll 104 remains substantially constant as the media supply roll decreases in size and weight. A handle 202 is mechanically coupled to the wheel 206 to permit an operator to lift the wheel 206 off of the media supply roll 104 as desired, such as to replace the media supply roll.

Figure 3:
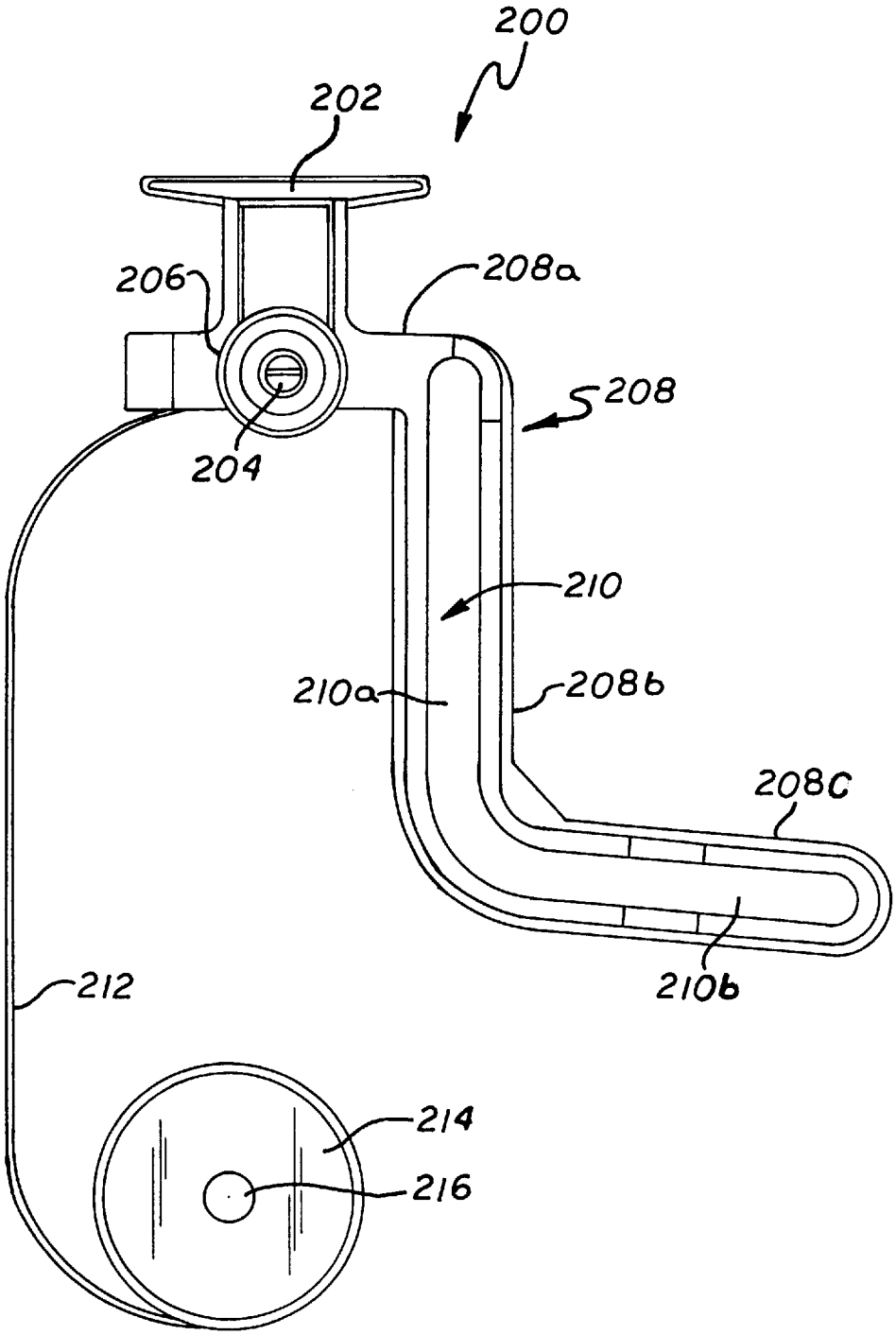
FIG. 3 illustrates an exemplary tension providing mechanism.

Referring next to FIG. 3, an exemplary embodiment of the tension providing mechanism 200 is depicted in greater detail. The tension providing mechanism 200 includes the handle 202 and a bracket 208. The bracket 208 includes an upper portion 208*a*, a lower vertical portion 208*b* and a lower horizontal portion 208*c*. The handle 202 is generally T-shaped and extends perpendicularly from the upper portion 208*a* of the bracket 208. The lower vertical portion 208*b* extends downwardly from an end of the upper portion 208*a*, and the lower horizontal portion 208*c* extends from a lower end of the lower vertical portion 208*b*. The lower vertical portion 208*b* and lower horizontal portion 208*c* combine to form a generally L-shaped member that includes an elongated, continuous channel 210, which comprises a vertical channel portion 210*a* and a horizontal channel portion 210*b*. In the preferred embodiment, the handle 202 and bracket 208 are unitarily formed of a rigid, lightweight material, such as plastic.

A shaft 204 extends outwardly of the upper portion 208*a* of the bracket 208. The wheel 206 described above is axially coupled to an end of the shaft 204 so that it rotates freely in cooperation with rotation of the media supply roll 104. The wheel 206 may further include a slightly pliant surface coating or material in order to maintain a positive connection between the media supply roll 104 and the wheel, without abrading, marring or otherwise damaging the media as it is paid out.

A drum 214 is coupled to the bracket by a spring 212. The spring 212 comprises a constant-force spring in the form of a metal tape wound around the drum 214. The spring 212 has a bias that provides a constant contracting force between the bracket 208 and the drum 214. As will be further described below, the drum 214 is axially coupled to a shaft 216 that extends from a portion of the media plate 300 disposed below the upper horizontal portion 208*a* of the bracket 208. The drum 214 rotates as the spring 212 contracts or expands.

Figure 4:
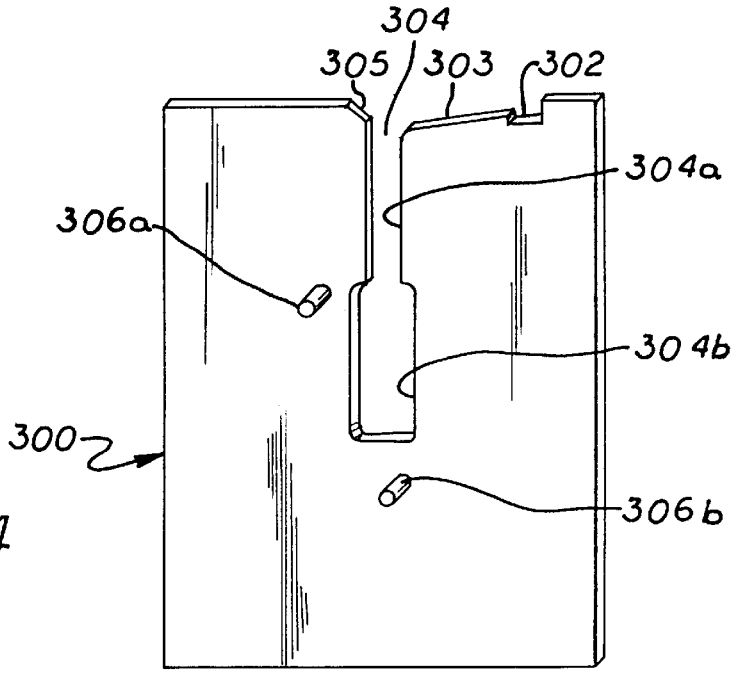
FIG. 4 illustrates an exemplary media plate.

Referring next to FIG. 4, an exemplary media plate 300 is depicted. It should be apparent that FIG. 4 illustrates the media plate 300 from an opposite orientation than the previously described illustrations of FIGS. 1 and 2, such that a rear surface of the media plate is shown in FIG. 4. The media plate 300 is generally rectangular in shape and includes a slot 304 and a notch 302 that each extend downward from an uppermost edge of the media plate. The slot 304 has a tapered opening 305 at the uppermost edge of the media plate, and has a first uniform width at a first portion 304*a* and a second uniform width at a second portion 304*b*. The second portion 304*b* provides an enlarged opening through the media plate 300 that permits the media supply post 116 to extend therethrough. In the illustrated embodiment, the slot 304 extends roughly halfway of an entire length of the media plate 300. The notch 302 is offset laterally from the slot 304 and is generally rectangular in shape. A shoulder region 303 is defined between the slot 304 and the notch 302 which has a level slightly below that of the uppermost edge of the media plate 300. The shoulder region 303 may slope slightly downward from the notch 302 to the slot 304.

The media plate 300 also includes two cylindrically shaped standoffs 306*a* and 306*b* as shown in FIG. 4. The two standoffs 306*a*, 306*b* extend perpendicularly from the surface of the media plate 300, and may be attached to the media plate in a conventional manner. The first standoff 306*a* is disposed alongside the slot 304 adjacent to the first portion 304*a* at an opposite side of the slot from the notch 302. The second standoff 306*b* is disposed below the second portion 304*b* of the slot 304 and is axially aligned with the slot. The standoffs 306*a*, 306*b* enable the tension providing mechanism 200 to be movably coupled to the media plate 300, as will be further described below.

Figure 5:
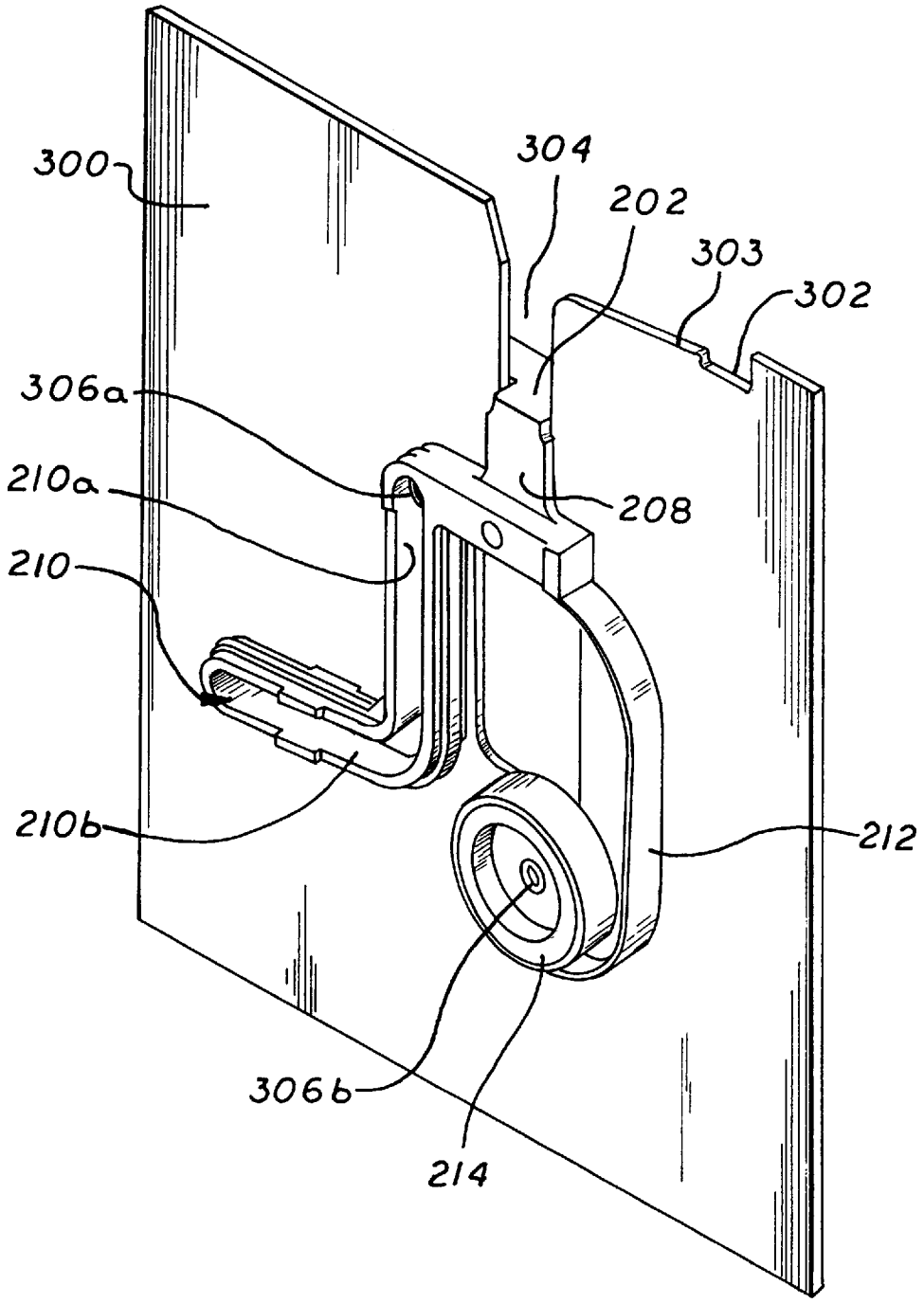
FIG. 5 illustrates a perspective rear view of the back tension providing mechanism mounted on an exemplary media plate.
Figure 6:
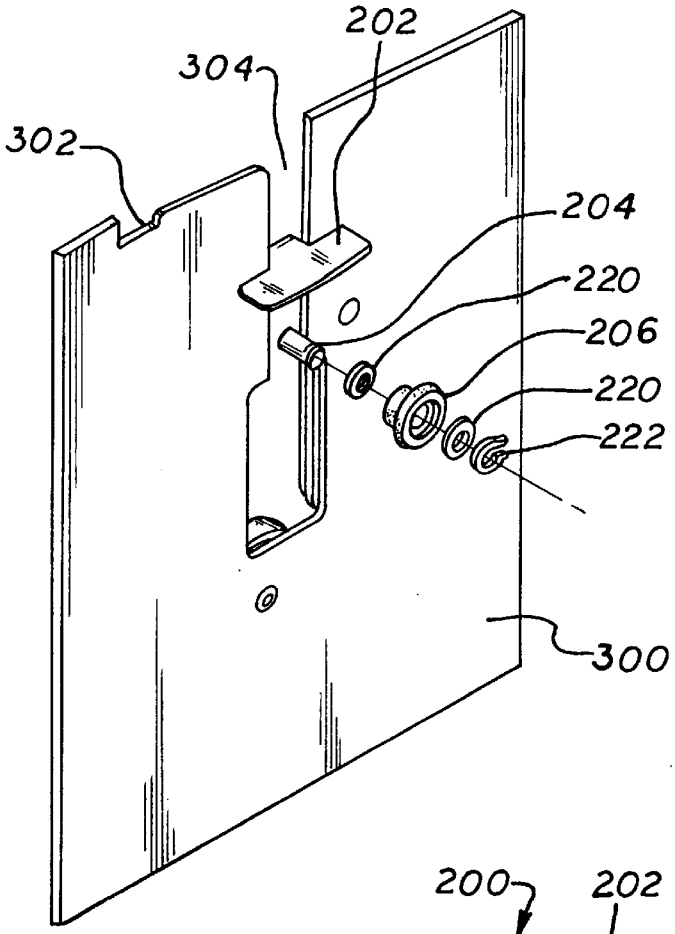
FIG. 6 depicts a perspective front view of the back tension providing mechanism and media plate illustrated in FIG. 5.

As shown in FIGS. 5 and 6, the handle 202 of the tension providing mechanism 200 extends through and is guided by the slot 304 formed in the media plate 300. Similarly, the shaft 204 extends through the slot 304 so that the wheel 206 is disposed at an opposite side of the media plate 300 from the rest of the bracket 208. The first standoff 306*a* fits within the channel 210 of the tension providing mechanism 200. The drum 214 is axially coupled to the second standoff 306*b* by extending through the center hole 216 of the drum. The tension mechanism 200 is thus mounted on the media plate 300 and is movable in an approximately vertical direction as guided by the cooperation of the handle 202 and the slot 304 in the media plate 300, as well as the cooperation of the first standoff 306*a* and the vertical portion 210*a* of the channel 210. The spring 212 provides a bias that urges the bracket 208 vertically downward toward the drum 214. The drum 214 is rotatable with respect to the media plate 300 so that the spring 212 winds around the drum as the bracket 208 moves downward toward the drum and unwinds from the drum as the bracket moves upward away from the drum. Thus, the spring 212 keeps the wheel 206 in contact with the media supply roll 104 as the size and weight of the media supply roll changes.

Figure 7:
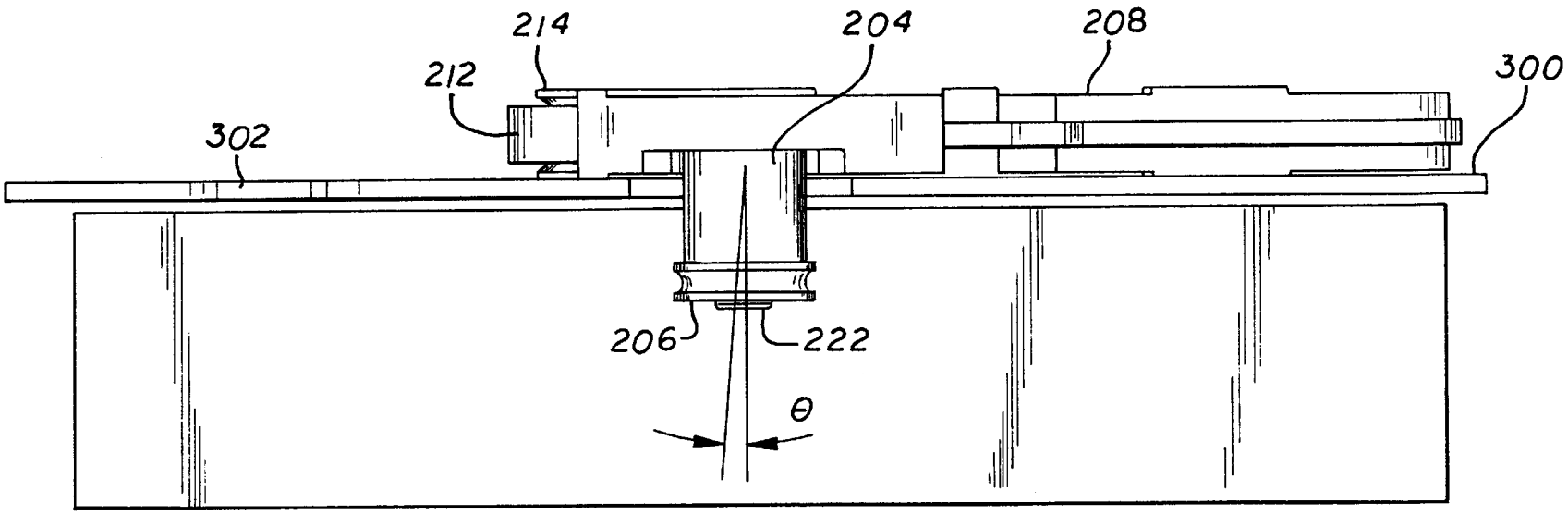
FIG. 7 depicts a sectional end view of the media plate as taken through the,.section 7—7 of FIG. 2.

FIG. 6 illustrates a particular attachment of the wheel 206 to the shaft 204 that extends from the bracket 208. Washers 220 are respectively disposed at either side of the wheel 206 to facilitate rotation of the wheel, and a locking ring 222 holds the wheel and washers securely onto the shaft 204. In addition, the wheel 206 is preferably canted slightly with respect to the direction of rotation of the media supply roll 104 to improve tracking of the media web 108 through the printer 100. For example, the wheel 206 may be canted by an angle θ as illustrated in FIG. 7. The angle θ may range up to 5°, and in the preferred embodiment an angle θ of 2° is utilized. The canting of the wheel 206 may be achieved by disposing the shaft 204 at the angle θ with respect to a perpendicular projection from the bracket 208. It should be apparent that the canting of the wheel 206 applies a slight sideways force on the media supply roll 104 to keep the media supply roll flush against the media plate 300 in order to prevent lateral movement of the media supply roll as the web of media is paid out.

Figure 8:
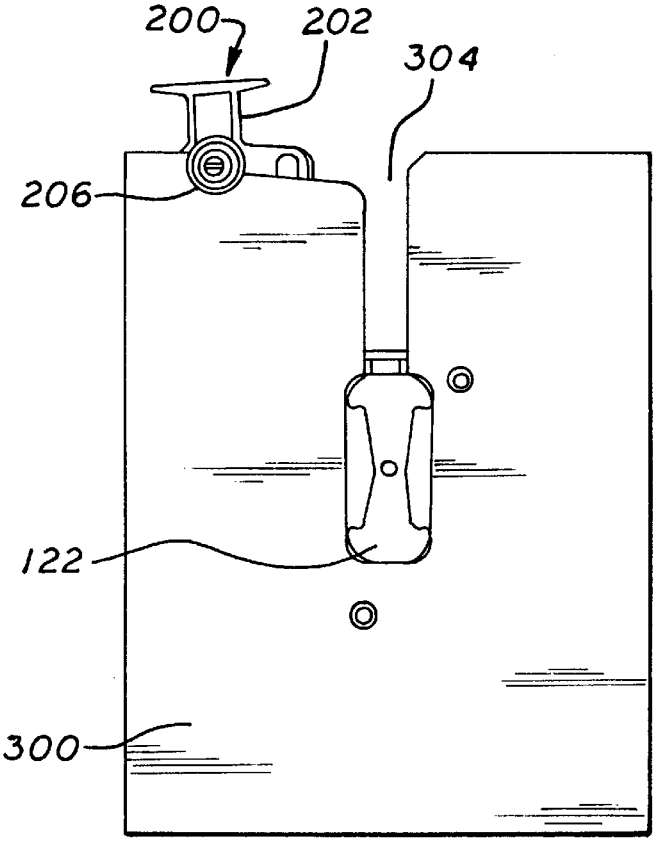
FIG. 8 illustrates an exemplary back tension mechanism manipulated to a stowed position.

As illustrated in FIG. 8, the tension providing mechanism 200 can be moved away from the media supply post 116, to facilitate replacement of the media supply roll. The handle 202 is lifted entirely out of the slot 304 in the media plate 300 and moved laterally across the shoulder region 303 of the media plate until the shaft 204 drops into the notch 302. The shaft 204 will remain in the notch 302 until a new media supply roll is installed, whereupon the handle 202 is intentionally returned to the operative position within the slot 304. Referring back to FIG. 3, the vertical channel 210*b* formed in the lower horizontal portion 208*c* of the bracket 208 allows the bracket to move horizontally across the top edge of the media plate 300 by cooperation with the standoff 306*b*.

Having thus described a preferred embodiment of the present invention, it should be apparent to those skilled in the art that certain advantages of the within system have been achieved. It should also be appreciated that various modifications, adaptations, and alternative embodiments thereof may be made within the scope and spirit of the present invention. For example, a rotating media supply post could be substituted for the stationary media supply post 116 illustrated in the preferred embodiment. Moreover, alternative types of springs, such as a coil spring, could be substituted for the constant-force spring 212 described above.

Accordingly, the above described preferred embodiment is intended to be illustrative only. The invention is limited only by the following claims.

What is claimed is:

1. An apparatus for providing back tension onto a print media web of a printer, comprising:

a plate having a post extended therefrom, said post being adapted to support a roll of print media thereon such that a central core of said roll of print media rests on an upper surface of said post allowing a web of said roll of print media to be paid out by rotation of said roll about said post;

a spring having a first end attached to a portion of said plate and a second end having a handle coupled thereto; and a pressing element coupled to said handle, said siring being biased to urge said pressing element against said media supply roll to maintain said roll firmly in contact with said post during rotation of said roll;

wherein said pressing element comprises a wheel which is rotatable in cooperation with said rotation of said roll, said wheel being disposed at a canted angle with respect to a direction of pay out of said web of said roll, wherein a sideways force is applied to said roll directing said roll against said plate; and wherein said handle comprises an elongated channel portion, and said plate further comprises a standoff fixedly attached to said plate, said standoff being adapted to fit within said elongated channel portion to provide a guide for slidable movement of said handle about said standoff, along a course defined by said elongated channel.

2. The apparatus of claim 1, wherein said elongated channel portion further includes a vertical portion and a horizontal portion, forming a single continuous channel.

3. An apparatus for providing back tension onto a print media web of a printer, comprising:

a plate having a post extended therefrom, said post being adapted to support a roll of print media thereon such that a central core of said roll of print media rests on an upper surface of said post allowing a web of said roll of print media to be paid out by rotation of said roll about said post;

a spring having a first end attached to a portion of said plate and a second end having a handle coupled thereto; and a pressing element coupled to said handle, said spring being biased to urge said pressing element against said media supply roll to maintain said roll firmly in contact with said post during rotation of said roll;

wherein said plate further comprises a slot disposed therein, said handle extending at least partially through said slot, said slot further providing a guide for movement of said handle.

4. An apparatus for providing back tension onto a print media web of a printer, comprising:

a plate having a post extended therefrom, said post being adapted to support a roll of print media thereon such that a central core of said roll of print media rests on an upper surface of said post allowing a web of said roll of print media to be paid out by rotation of said roll about said post;

a spring having a first end attached to a portion of said plate and a second end having a handle coupled thereto;

a pressing element coupled to said handle, said spring being biased to urge said pressing element against said media supply roll to maintain said roll firmly in contact with said post during rotation of said roll and means for locking said handle in a position in which said pressing element does not contact said media roll.

5. An apparatus for providing back tension onto a print media web of a printer, comprising:

a plate having a post extended therefrom, said post being adapted to support a roll of print media thereon such that a central core of said roll of print media rests on an under surface of said post allowing a web of said roll of print media to be paid out by rotation of said roll about said post;

a spring having a first end attached to a portion of said plate and a second end having a handle coupled thereto;

a pressing element coupled to said handle, said spring being biased to urge said pressing element against said media supply roll to maintain said roll firmly in contact with said post during rotation of said roll; and means for locking said handle in a position in which said pressing element does not contact said media roll;

wherein said locking means further comprising a notch provided in said plate detached from said slot, said handle being adapted for selective movement to said notch.

6. An apparatus for providing back tension onto a print media web of a printer, comprising:

a plate having a post extended therefrom, said post being adapted to support a roll of print media thereon such that a central core of said roll of print media rests on an upper surface of said post allowing a web of said roll of print media to be paid out by rotation of said roll about said post;

a spring having a first end attached to a portion of said plate and a second end having a handle coupled thereto;

a pressing element coupled to said handle, said spring being biased to urge said pressing element against said media supply roll to maintain said roll firmly in contact with said post during rotation of said roll; and a rotatable drum coupled to said media plate, and said spring further comprises a tape spring wound onto said drum.

7. An apparatus for a printer, comprising:

a plate having a post extended therefrom, said post being adapted to support a roll of print media thereon such that a central core of said roll of print media rests on an upper surface of said post allowing a web of said roll of print media to be paid out by rotation of said roll about said post;

means for pressing said roll of print media against said post, thereby providing back tension onto said web; and means for applying a sideways force on said roll to direct said roll against said plate;

wherein said means for pressing further comprises:

a spring having a first end attached to a portion of said plate and a second end having a handle couple thereto; and a pressing element coupled to said handle, said spring being biased to urge said pressing element against said media supply roll to maintain said roll firmly in contact with said post during said rotation of said roll; and wherein said handle comprises an elongated channel portion, and said plate further comprises a standoff fixedly attached thereto, said standoff being adapted to fit within said elongated channel portion to provide a guide for slidable movement of said handle about said standoff along a course defined by said elongated channel.

8. The apparatus of claim 7, wherein said elongated channel portion further includes a vertical portion and a horizontal portion, forming a single continuous channel.

9. An apparatus for a printer, comprising:

a plate having a post extended therefrom, said post being adapted to support a roll of print media thereon such that a central core of said roll of print media rests on an upper surface of said post allowing a web of said roll of print media to be paid out by rotation of said roll about said post;

means for pressing said roll of print media against said post, thereby providing back tension onto said web; and means for applying a sideways force on said roll to direct said roll against said plates;

wherein said means for pressing further comprises:

a spring having a first end attached to a portion of said plate and a second end having a handle coupled thereto; and a pressing element coupled to said handle, said spring being biased to urge said pressing element against said media supply roll to maintain said roll firmly in contact with said post during said rotation of said roll; and wherein said plate further comprises a slot disposed therein, said handle extending at least partially through said slot, said slot further providing a guide for movement of said handle.

10. An apparatus for a printer, comprising:

a plate having a post extended therefrom, said post being adapted to support a roll of print media thereon such that a central core of said roll of print media rests on an upper surface of said post allowing a web of said roll of print media to be paid out by rotation of said roll about said post;

means for providing back tension onto said web, said means for providing back tension disposed on said plate, wherein said means for providing back tension further comprises:

a spring having a first end attached to a portion of said plate and a second end having a handle coupled thereto; and a pressing element coupled to said handle, said spring being biased to urge said pressing element against said media supply roll to maintain said roll firmly in contact with said post during said rotation of said roll; and a rotatable drum coupled to said plate, and said spring further comprises a tape spring wound onto said drum.

* * * * *